United States Patent [19]

Krieger

[11] 4,103,412

[45] Aug. 1, 1978

[54] METHOD OF MAKING A FOAM FILLED DIE CAST BAT

[75] Inventor: George H. Krieger, St. Louis, Mo.

[73] Assignee: St. Louis Diecasting Corporation, Bredgeton, Mo.

[21] Appl. No.: 800,556

[22] Filed: May 25, 1977

Related U.S. Application Data

[60] Division of Ser. No. 685,168, May 11, 1976, Pat. No. 4,056,267, which is a continuation-in-part of Ser. No. 468,815, May 10, 1974, abandoned, and a continuation-in-part of Ser. No. 549,701, Feb. 13, 1975, abandoned.

[51] Int. Cl.[2] ..... B23P 3/00; B23P 19/04

[52] U.S. Cl. ..... 29/460; 29/527.3

[58] Field of Search ..... 29/460, 527.3; 273/72 A, 82 A

[56] References Cited

U.S. PATENT DOCUMENTS

| | | | |
|---|---|---|---|
| 1,499,128 | 6/1924 | Shroyer, Jr. | 273/72 A UX |
| 1,611,858 | 12/1926 | Middlekauff | 273/72 A UX |
| 1,620,728 | 3/1927 | Jackson | 273/72 A UX |
| 1,950,342 | 3/1934 | Meshel | 273/72 A UX |
| 2,101,714 | 12/1937 | Keeney | 273/72 R UX |
| 3,216,727 | 11/1965 | Hunter | 273/72 A UX |
| 3,224,769 | 12/1965 | Nickell | 273/72 A UX |
| 3,228,687 | 1/1966 | Bauer | 273/82 A |
| 3,727,295 | 4/1973 | Gildemeister | 29/460 X |
| 3,801,098 | 4/1974 | Gildemeister | 273/72 A |

*Primary Examiner*—Charlie T. Moon

*Attorney, Agent, or Firm*—Rogers, Eilers & Howell

[57] ABSTRACT

A foam filled die cast metal baseball and softball bat has an all metal skin welded into a unit. The bat is formed by die casting the cylindrical handle and barrel of the bat in one piece and by welding an end cap to the cylindrical barrel to form the unitary skin structure of the bat. A foaming, sound-deadening and strengthening plastic material is then introduced into the hollow interior of the bat through an opening in the handle portion of the bat. The added material foams to fill the interior with a reinforcing semi-rigid foam. The bat has a steel safety rod embedded in the foam center of the bat. The end cap structure is formed of a roughly hemispherical cap and has a sleeve which fits into the interior of the barrel end of the bat. A shoulder on the cap abuts the bat end and extends outwardly radially past the periphery of the bat. The cap is joined to the barrel portion by resistance welding in a rotating lathe under an inert gas atmosphere.

11 Claims, 7 Drawing Figures

METHOD OF MAKING A FOAM FILLED DIE CAST BAT

BACKGROUND AND SUMMARY OF THE INVENTION

This is a division of application Ser. No. 685,168 filed May 11, 1976, now U.S. Pat. No. 4,056,267, which is a continuation-in-part of application Ser. No. 468,815 filed May 10, 1974, now abandoned, and is a continuation-in-part of application Ser. No. 549,701 filed Feb. 13, 1975, now abandoned.

Metal bats, such as those known previously in the art, have a basic cylinder piece formed of drawn or die cast metal, which makes up the barrel and handle of the bat. In previous die cast bats, a rubber or plastic insert capped the barrel or handle end of the bat. This method of construction has a number of inherent disadvantages in that the bat structure is weak due to the lack of unitary structure and due to the inherent weakness of the material used to form the insert. Previous bats often dented from impacts with a ball, often occurring near the end of the barrel, in the approximate area of the inserted plug. Repeated impacts and denting eventually caused failure of the bat by breaking loose the rubber or plastic insert. Attempts to produce a welded, unitary end cap for a die cast bat have not been successful, up to now, due to the difficulty in making a sound, non-porous weld. Previous attempts at producing a welded cap failed frequently by cracking at the weld seam and denting in the area adjacent to the barrel end of the bat.

Another problem with previous die cast bats has been that a small number of them fail by breaking at the handle in the batter's hands upon impact with a ball. The broken piece separates from the handle portion which the batter is holding and flies through the air which creates a possibility of injury. While this type of failure is undesirable, it is not much different from the failure of a wooden bat when it splinters and separates upon impact with a thrown ball. However, people don't expect this type of failure to occur in a die cast metal bat.

Applicant has solved the problems of prior die cast bats and achieved a die cast bat having a unitary metal skin structure, including the end cap and a safety-strengthening device in the interior. This construction greatly strengthens the structure of the bat, particularly in the area near the barrel end of the bat while eliminating the danger of flying broken bat pieces. Applicant's welded end cap doesn't work loose and fall out with wear and abuse. Furthermore, if a bat does break, the broken pieces are held in place by the safety-strengthening device. Applicant achieves this improved structure by forming the end cap of the identical die cast material from which the rest of the bat structure is made and welding the end cap onto the bat to form a unitary skin structure for the bat. But before the bat is filled with the resilient foam and sealed with the end cap, the safety-strengthening device, normally a long rod with an anchoring eyelet at each end, is placed into the hollow bat.

To produce a strong welded structure it was necessary for applicant to overcome several significant problems in forming a unitary skin structure. Die cast material, particularly magnesium, is inherently porous and difficult to weld in a manner to achieve a strong bond between the two pieces of metal at the joining line. Applicant has achieved a strong weld seam by resistance welding the cap structure onto the bat, and by forming the cap of the identical casting alloy as the rest of the bat.

The weld is accomplished by rotating the bat on a lathe while automatically resistance welding the cap to the bat in an inert gas atmosphere. The rotation of the bat is continued so the weld is repeated several times, allowing entrapped gases to escape from the weld seam, resulting in a strong, non-porous weld. Additional metal for forming the weld seam may be supplied by casting the end cap with an additional quantity of metal in the cap at the area adjacent to the weld seam. During welding this portion of the cap melts and flows into the seam to form a smooth, even and relatively non-porous bead in the weld seam. By repeated welding a non-porous seam may be achieved without the additional metal, however. A strong weld is achieved in spite of the fact that the die cast material of the bat barrel and cap itself are extremely porous due to the inherent porosity of die cast metal.

The safety-strengthening device serves to strengthen the bat by acting like a spine or backbone for the "shell" of the outside unitary skin structure. This additional strengthening helps prevent the small hair line cracks from developing which provide the stress concentrating fault line along which the entire bat shears.

However, even if a bat does shear into two or more pieces, the safety-strengthening device makes it impossible for a piece of the bat to separate and fly through the air. Because both ends of the rod are firmly anchored in the foam and because the rod has sufficient tensile strength to withstand the shear force generated by the broken piece, the rod will retain the broken piece in place during the swing and impact which shears the unitary metal skin.

DESCRIPTION OF THE PREFERRED EMBODIMENTS

Figure 1:
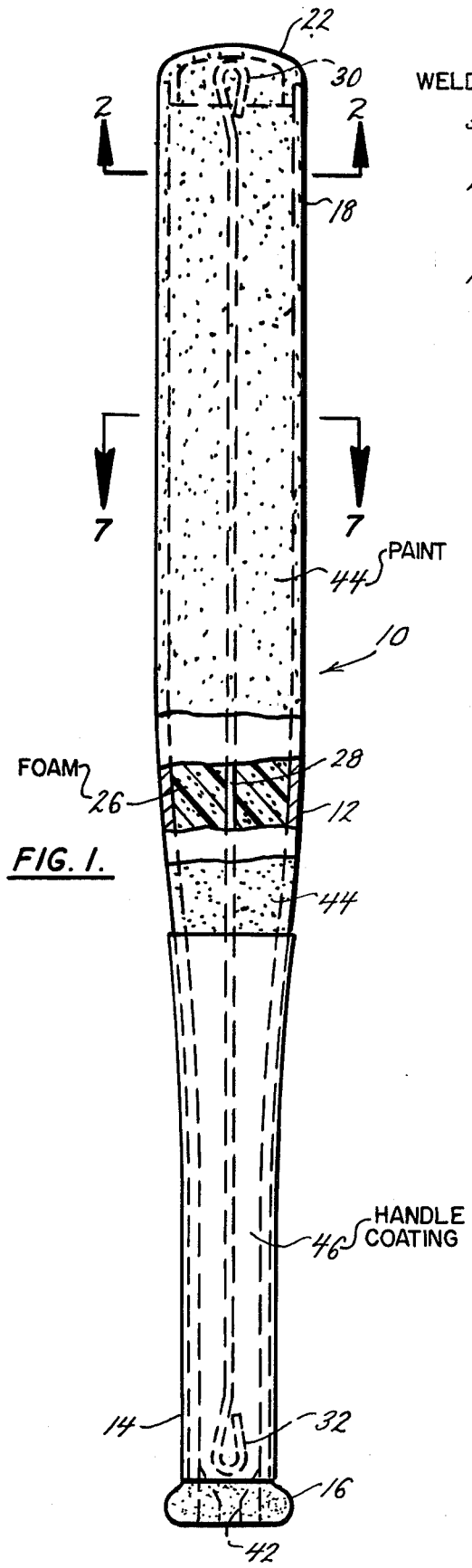
FIG. 1 is a plan view of a completed bat of the invention, showing the bat structure with the unitary welded cap, the foam filled core, and the safety strengthening device.
Figure 6:
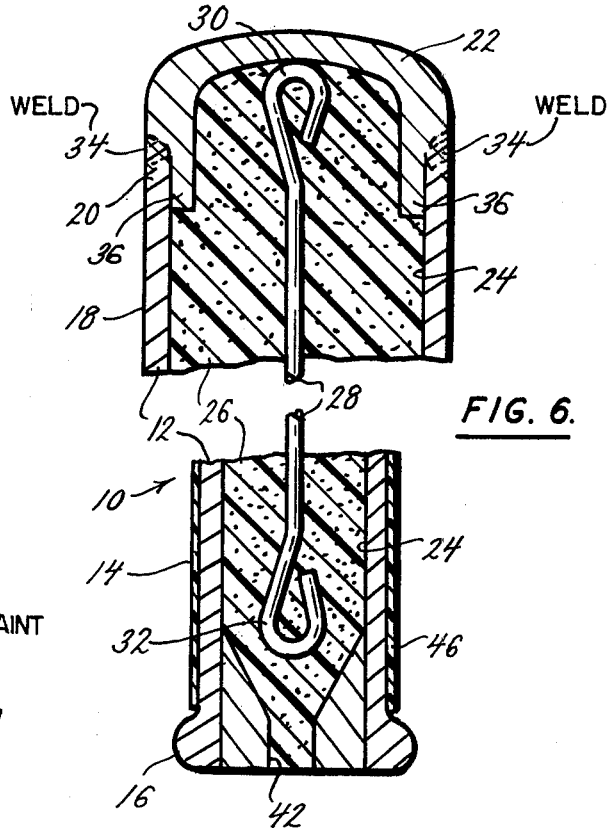
FIG. 6 is a broken sectional view detailing the ends of the safety-strengthening device.
Figure 7:
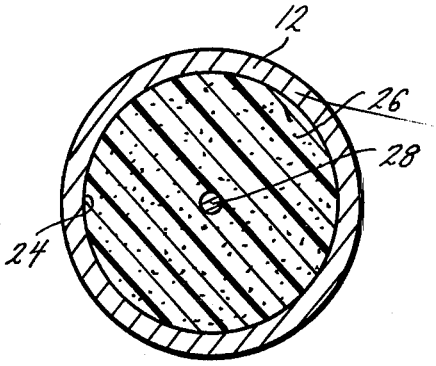
FIG. 7 is a sectional view taken along lines 7—7 in FIG. 1.

Referring to the drawings, a foam filled unitary metal skin bat 10 is formed of a die cast alloy metal tube 12 having a handle portion 14 with a knob 16 at one end and having a barrel portion 18 with an open end 20. Welded to the bat open end 20 is a die cast end cap 22 or 23, preferably formed of the same alloy as the bat tube. Preferably both the bat and cap are cast of magnesium die casting alloys such as alloy 91, 81 or 71. The interior of the casting is hollow and has an interior wall 24. The hollow portion is filled with an expanded foam material 26, preferably of the foam polyurethane type. Safety-strengthening device 28 is embedded in the foam 26. The safety-strengthening device 28 has an anchor eye hook 30 formed in the barrel end and another anchor eye hook 32 formed in the handle end.

The safety-strengthening device 28 may be formed of any relatively high tensile strength metal. Number 12 gauge tempered spring steel wire (0.1055 inches diameter) or the equivalent has been found to be satisfactory. The anchor eye hooks 30 and 32 can be any shape which will provide sufficient surface area for the resilient foam filler 26 to effectively hold the safety-strengthening device 28 in place both during everyday use and under a failure condition. The eye hook shape is not critical to an effective safety device 28. Eyelets, hooks prongs or other equivalent structures would be satisfactory.

In use, the safety-strengthening device 28 acts like a backbone or spine to the die cast metal bat 10. This extra longitudinal strength is effective in reducing the tendency of a die cast metal bat to develop hair line cracks just above where a batter normally holds the bat when he hits the ball. Prior metal die cast bats were susceptible to this type of failure, though no more so than a conventional wooden bat was to splintering or other failure. For the few bats that develop these hair line cracks in spite of this extra strength, the safety-strengthening device serves a second purpose. These hair lines cracks act as stress concentrators which form the fault lines for a sudden fracture of the entire die cast metal bat 10. The safety-strengthening device 28 will prevent a complete separation of the broken piece from the handle portion by withstanding the shear force and remaining anchored in place. After failure a die cast metal bat 10 is unsuitable for further use either with or without the safety-strengthening device 28.

Figure 2:
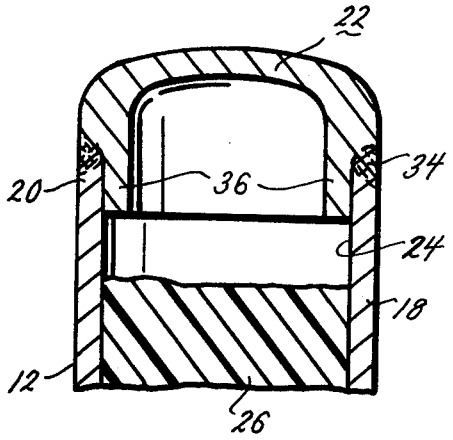
FIG. 2 is an enlarged partial sectional view of the bat of FIG. 1 showing the end cap structure, the weld bead and the foam core, and without the reinforcing rod.
Figure 5:
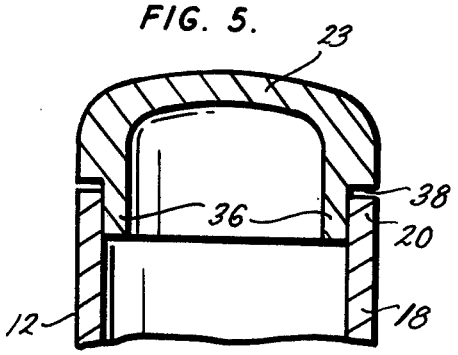
FIG. 5 is a partial sectional view of the bat and cap, similar to FIG. 4, but using a cap without the weld metal shoulder.
Figure 4:
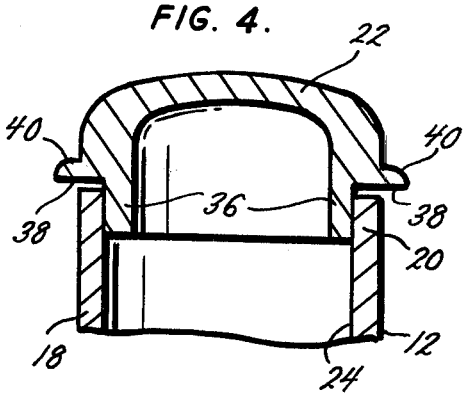
FIG. 4 is a partial sectional view of the bat and cap showing the cap in place prior to welding.

As shown in FIGS. 2, 4 and 5, the end cap 22 or 23 is attached to the end 20 of the bat barrel 18 by welding, shown at 34. The weld 34 is a circumferential weld which passes completely around the end 20 of the bat barrel 18 to form a circular weld seam. Extra strength and rigidity at the seam line between cap 22 or 23 and end 20 of the bat barrel 18 is provided by a depending sleeve 36 on the cap 22 and 23 which fits inside the end 20 of the bat barrel 18 and fits snugly against the interior wall 24 in the area adjacent end 20, thus providing additional rigidity and strength in the bat in the area of the end 20. Sleeve 36 additionally stiffens and strengthens the weld seam 34. Sleeve 36 extends into end 20 of the bat barrel 18 a distance of about one centimeter or more to provide the desired strength. A greater or lesser length may also be used, as desired. A shoulder 38 on the cap 22 and 23 snugly abuts against the end 20 of the bat barrel 18 and is bonded to the end 20 by the weld seam 34.

Figure 3:
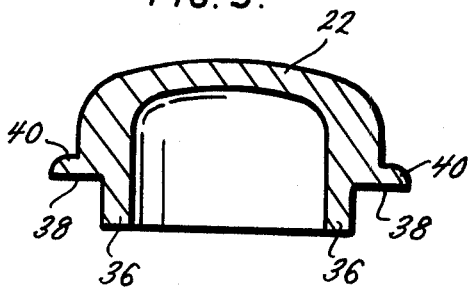
FIG. 3 is a cross sectional view of the end cap of the invention prior to welding to the bat structure, showing the dome shape, the collar and the weld metal shoudler.

To produce the unitary metal skin bat 10 shown, the bat barrel portion 18 and the cap 22 or 23 in the form shown in FIG. 3 are both pre-cast, preferably of the identical magnesium alloy. The cap 22 or 23 in the form cast has depending sleeve 30 and shoulder 32. Cap 22 has an outward extension 40 extending outwardly beyond the normal contour of cap 22 in its finished state such as shown in FIG. 2. This projection 40 supplies weld metal for weld seam 34. Projection 40 can also be formed on the bat barrel 18 immediately adjacent to the end 20, if desired.

To form the bat after the cap and bat barrel 18 have been pre-cast, the bat barrel 18 is trimmed to form a uniform flat end at 20 by sawing and is wire brushed to bright metal. The cap 22 or 23, as cast, is wire brushed and placed with the sleeve 36 inside the open end 20 of the bat barrel 18. The shoulder 38 is placed in an abutting relationship with the end 20, and the bat barrel 18 with the inserted cap 22 is placed on a lathe. The bat is rotated in the lathe using rectangular key way 42 which is cast into the handle of the bat. The cap 22 or 23 is held in the lathe by a center and as the bat is rotated, weld seam 34 is formed by a resistance welding machine using an inert gas atmosphere. If cap 22 is used, metal for the weld seam 34 is provided by melting the outwardly extending portion 40 of the cap down into the seam. By melting the outwardly extending portion 40 down to form the weld seam 34, a smooth end profile is formed in the bat. If cap 23 is used, metal for the weld seam 34 is supplied by cap 23 and end 20 of the bat. Cap 23 has the advantage of producing a weld with a very low profile, requiring less sanding to finish and minimizing the possibility of exposed porosities.

The bat is rotated on the lathe a number of revolutions during welding, preferably about six revolutions. For example, welding will preferably be conducted for about twelve seconds and the bat will be rotated at about thirty revolutions per minute. Porosity of the weld is primarily due to dirt, grease and gas trapped into the porosities of the parent metal. Repeated welding burns or boils off most of the porosity causing material and re-fuses the weld to a substantially non-porous joint.

After welding, the bat is profile sanded to remove weld splatter and mold marks and to form a smooth exterior. The bat is pickled in a standard dichromate pickle to resist corrosion. The safety-strengthening device 28 is then placed inside the hollow bat structure before it is filled with a resilient foam material which strengthens the structure and deadens the bat's vibration characteristics. No centering of the safety-strengthening device 28 in the bat structure is required as it will work equally well regardless of its position. The preferred foams are rigid and semi-rigid urethane foams. Both foams of uniform density and skin-forming foams may be used. The bat is filled with foam by standing the bat in a vertical position with the handle at the top. A catalytic reacting urethane foaming material with the catalyst mixed therein is introduced into the interior of the bat through the key way 42. The material flows down to the cap end of the bat and reacts to foam and expands and fills the bat to form a uniform strengthening core structure as shown at 26. The bat is sealed during foaming to increase formation of a dense foam.

Any small porosity at the weld, for example, at the point the welding tip is removed from the weld, may be filled with a filler material, such as epoxy, and sanded smooth prior to painting the bat. The weld porosities are extremely minor and the weld is substantially non-porous. The great majority of the welded bats require no filling, even at the weld break off point.

The foam filled bat may then be painted with a coating material 44 and stenciled with a variety of indicia of size, weight or trademark. A soft textured coating material 46 may be applied to the handle area 14 to give a cushioning feel to the bat. Decorative tape may be applied and a plastic end cap may be inserted in key way 42. Typical materials used for the painting may include enamels of the oil or synthetic types such as the catalytic urethane coating materials. The handle coating may be of vinyl, neoprene, or similar soft textured coating material.

Various changes and modifications may be made in this invention, as will be readily apparent to those skilled in the art. Such changes and modifications are within the scope and teaching of this invention as defined by the claims appended hereto.

I claim:

1. A method for manufacturing a foam filled metal bat comprising the steps of die casting a generally elongated porous metal tube element having a barrel of enlarged diameter at one end and a handle of reduced diameter at the other end, the metal tube being hollow and open at the barrel end, die casting a second porous metal cap element having a portion adapted to fit within the barrel end of the bat blank to form a closed end portion, the cap having a projection which abuts against the end portion of the barrel, welding the cap to the barrel in an inert gas atmosphere to form a substantially non-porous weld seam, sanding the cap and barrel portion in the area adjacent to the weld seam to form a smooth profile, filling the capped bat structure with a foam material, and coating the surface of the bat.

2. A method for making a foam filled metal bat comprising the steps of:

(a) die casting a generally elongated porous metal tube element, (b) die casting a second porous metal cap element having a portion adapted to fit within the metal tube element to form a closed end portion, (c) welding the cap to the metal tube element to form a substantially non-porous weld seam, and (d) filling the capped bat structure with a foam material.

3. The method of claim 2 further comprising the step of sanding the cap and metal tube element in the area adjacent to the weld seam to form a smooth profile.

4. The method of claim 3 further comprising filling small porosities at the weld before sanding.

5. The method of claim 1 further comprising the step of inserting a safety strengthening device into the capped bat structure before filling with foam material.

6. The method of claim 1 further comprising the step of pickling the bat structure after welding.

7. The method of claim 1 further comprising the steps of coating the surface of the bat structure after filling with foam material.

8. The method of claim 7 further comprising the step of stenciling indicia and applying tape to the bat structure after coating the surface.

9. The method of claim 7 further comprising the step of applying a second coating to a portion of the bat structure to cushion it as an aid in grasping and holding the bat structure.

10. The method of claim 1 further comprising sealing the bat structure after filling with a foam material to increase formation of a dense foam.

11. A method of manufacturing a foam filled metal bat comprising the steps of:

(a) die casting a generally elongated porous metal tube element having a barrel portion of enlarged diameter at one end and a handle portion of reduced diameter at the other end, the metal tube being hollow with an opening at the barrel end substantially larger than the opening at the handle end;

(b) die casting a porous metal cap element having a portion adapted to fit within the barrel end of the bat element to form a closed end portion, the cap having a circumferential projection which abuts the end of the barrel;

(c) welding the cap to the barrel in an inert gas atmosphere to form a substantially non-porous weld seam;

(d) sanding the cap and barrel portion at the weld seam and in the area adjacent the weld seam to form a smooth profile along the surface of the barrel;

(e) pickling the bat to resist corrosion;

(f) inserting a safety strengthening device into the bat through the handle end opening;

(g) filling the bat with foam through the handle end opening, the foam reacting to expand and completely fill the interior of the bat and anchor the safety strengthening device therein;

(h) sealing the bat after it is filled with foam but before the foam has completed reaction, thereby increasing the density of the foam within the bat;

(i) filling any remaining proposities at the weld with a filler material and sanding the filled areas smooth;

(j) painting the bat with a coating material and stenciling a variety of indicia thereon; and (k) applying a textured material to the handle area to aid a user in grasping the bat.

* * * * *